United States Patent [19]

Davis, Jr.

[11] 4,331,425

[45] May 25, 1982

[54] GOLF SCORE CARD AND HOLE INFORMATION GUIDE

[76] Inventor: James W. Davis, Jr., P.O. Box 133, Montgomery, Ala. 36101

[21] Appl. No.: 195,631

[22] Filed: Oct. 9, 1980

[51] Int. Cl.[3] ..... A63B 57/00; A63B 69/36

[52] U.S. Cl. ..... 434/252; 273/176 L; 283/63 A

[58] Field of Search ..... 273/32 R, 32 H, 176 L; 434/252; 40/401, 390; 283/1 A, 63 A

[56] References Cited

U.S. PATENT DOCUMENTS

| | | | |
|---|---|---|---|
| 83,908 | 11/1868 | Bond | 40/401 |
| 457,466 | 8/1891 | Thayer | 283/63 A X |
| 538,491 | 4/1895 | Angell | 283/63 A X |
| 1,353,889 | 9/1920 | Brown | 434/252 X |
| 2,687,902 | 8/1954 | Becker | 283/63 A |
| 3,805,411 | 4/1974 | Andrews | 273/176 L X |
| 3,820,786 | 6/1974 | Candor | 273/176 L X |
| 3,949,987 | 4/1976 | Candor | 273/176 L X |

*Primary Examiner*—Harland S. Skogquist
*Attorney, Agent, or Firm*—Harvey B. Jacobson

[57] ABSTRACT

A booklet having a plurality of pages incorporated therein on which the enlarged depictions of each hole of a golf course appear together with descriptive material relating to the holes with the upper outer corners of each page including a cutout area providing access to and revealing a score recording area along the inner surface of the right-hand marginal portion of the last page of the booklet. The bottom edge of the cutouts are progressively lower from the first hole to the last hole of the golf course and the bottom edge of the cutout provides a guideline in relation to the score recording area so that the spaces for the score for the holes depicted on the pages would be immediately above the bottom edge of the cutout on that page. Also, the cutouts reveal the actual score descending from the first hole as play progresses around the golf course.

6 Claims, 3 Drawing Figures

FIG. 1
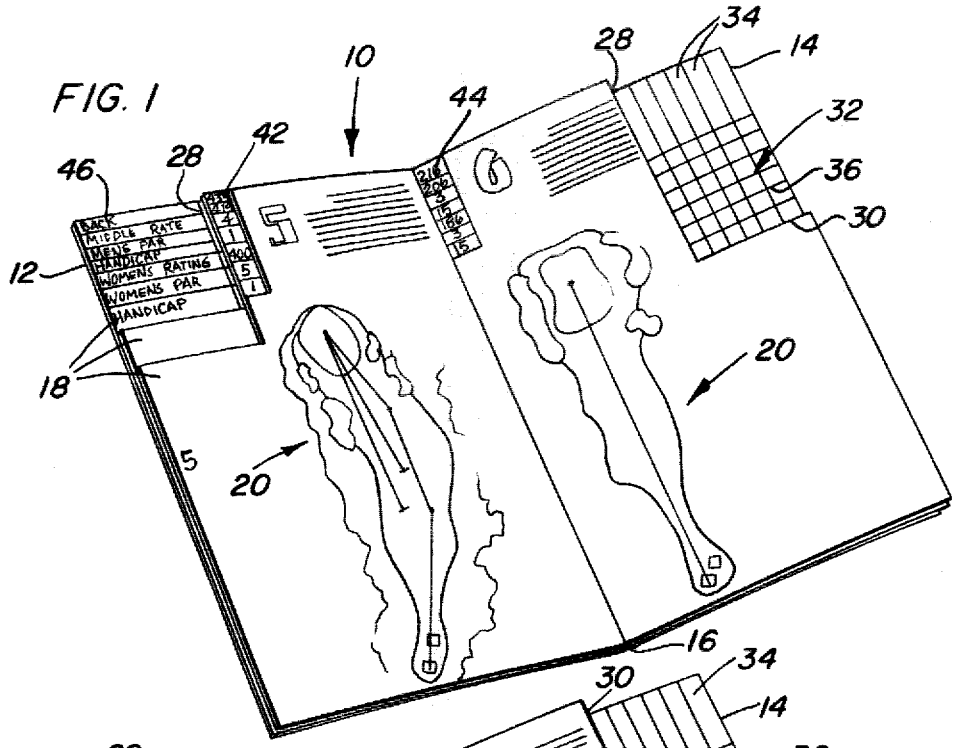
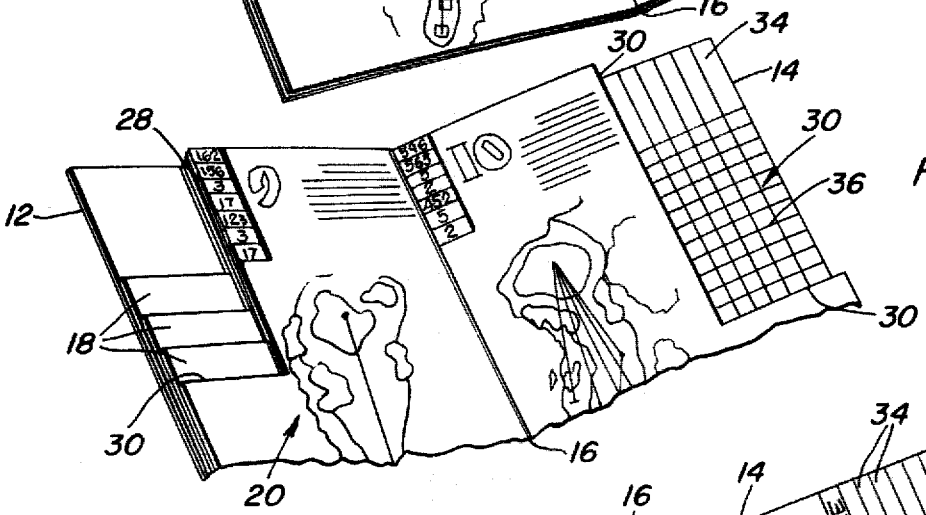
FIG. 2
FIG. 3
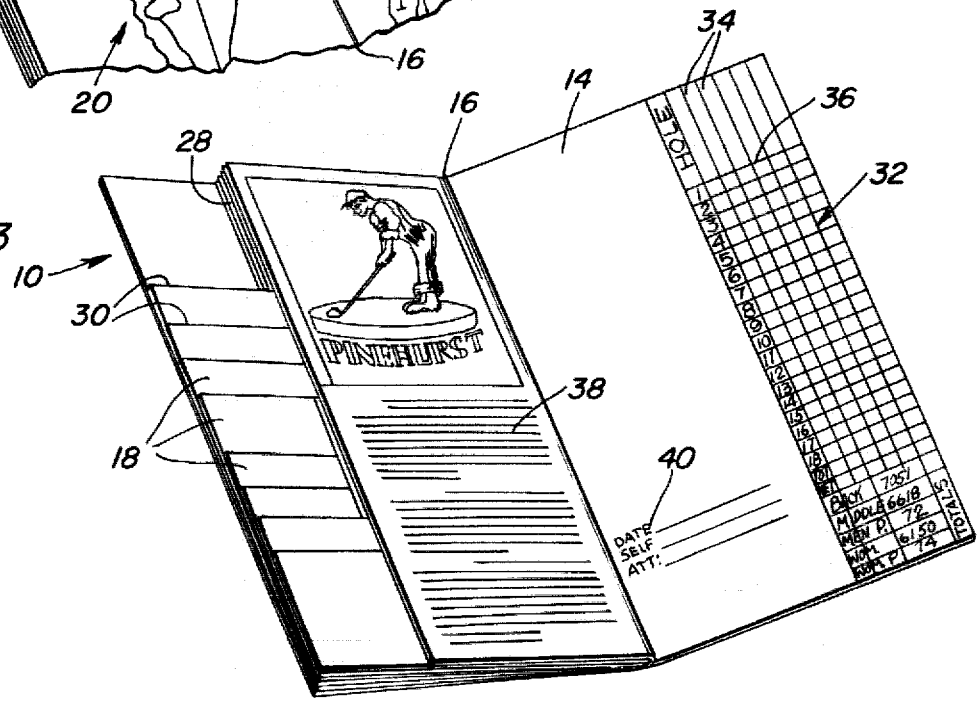

GOLF SCORE CARD AND HOLE INFORMATION GUIDE

BACKGROUND OF THE INVENTION

1. Field of the Invention

The present invention generally relates to a golf score card and hole information guide in the form of a booklet which provides enlarged depictions of each hole in a golf course and includes a structural arrangement which enables accurate recordation of the shots taken by each player when playing golf and providing a readily observable actual score descending from the first hole as play progresses.

2. Description of the Prior Art

U.S. Pat. No. 3,820,786, issued to James T. Candor on June 28, 1974 and U.S. Pat. No. 3,949,987, issued to James T. Candor on Apr. 13, 1976, disclose pictorial illustrations and other information relating to the holes of a golf course in which a game of golf may be simulated. U.S. Pat. No. 3,552,290, issued to Frederick C. Brechtel on Jan. 5, 1971, discloses scale maps made by the use of a photographic technique which illustrates the layout of the holes of a golf course to facilitate playing of that course. U.S. Pat. No. 3,685,168, issued to Edward G. Reitz on Aug. 22, 1972, discloses a relief model of the holes of a golf course which relates primarily to the contours of the green and positioning of the cup therein. U.S. Pat. No. 3,805,411, issued to Charles L. Andrews, Jr. on Apr. 23, 1974, discloses a score card and layout of the holes of a golf course with the simulated fairways having arcuate indicia associated therewith to provide certain information to golfers playing a golf course. Many golf courses have pictorial or schematic depictions of the course in the clubhouse and touring golfers frequently make notes regarding a particular golf course during practice rounds. Also, a score card is normally provided for each golfer playing a particular course. However, even with these devices being available, golfers frequently are not provided with sufficient information regarding all of the holes of a particular golf course and erroneous recordation of scores sometimes occurs.

SUMMARY OF THE INVENTION

An object of the present invention is to provide a golf score card and hole information guide in the form of a booklet having multiple pages therein with each page including at least one hole of a golf course depicted thereon with other indicia setting forth various information with respect to that particular hole.

Another object of the invention is to provide a golf score card and hole information guide in accordance with the preceding object in which the rear cover or page of the booklet includes a vertically oriented score recording area along the right-hand margin thereof with multiple vertical segmented columns being provided thereon to record the scores of individual players in a descending manner from the first hole as play progresses.

A further object of the present invention is to provide a golf score card and hole information guide in accordance with the preceding objects in which each page of the booklet, except for the last page or cover, is provided with a cutout in the upper right-hand corner thereof for revealing a portion of the score recording area with the lower edges of the cutouts progressively descending and forming a bottom line underlying the score recording area on which the score for that particular hole or holes shown on that particular page is to be recorded.

Yet another object of the invention is to provide a booklet in accordance with the preceding objects which is simple in construction, easy to use, effective in imparting information to the golfers and enabling their score to be accurately recorded.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the golf score card and hole information guide of the present invention illustrating two pages of the booklet and the relationship of the cutouts to the score recording area on the inner surface of the rear cover or page.

FIG. 2 is a perspective view illustrating additional successive pages of the booklet.

FIG. 3 is a perspective view illustrating the booklet with the inner surface of the rear cover or page revealed to show the score recording area along the right-hand margin thereof.

DESCRIPTION OF THE PREFERRED EMBODIMENT

Referring now specifically to the drawings, the booklet forming the golf score card and hole information guide of the present invention is generally designated by the numeral 10 and may be of any convenient size which will fit into the pocket on a golf club bag, attached to a golf cart and the like. The booklet 10 includes a front cover page 12 and a rear cover page 14 folded along a vertical centerline 16 together with a plurality of pages 18 which are also folded along the vertical centerline 16 and bound in a conventional manner such as by staples, stitching or the like. The booklet 10 may be constructed of paper or cardboard of any suitable thickness and the exterior of the booklet may be provided with a pictorial illustration of a golf course, clubhouse or the like and include informational indica relating to the name of the country club, the golf professional and the like. The inside of the cover page 12 and the facing surface of the first page of the booklet may have a pictorial illustration of the entire golf course and other printed indicia such as the rules of play and the like. Succeeding pages 18 in the booklet have an enlarged depiction 20 of succeeding holes on a golf course with the pages 18 illustrated in FIG. 1 illustrating holes 5 and 6. Various colors may be used for such depiction such as green for the fairway and a darker shade of green for the tee and green areas, brown or white for the sand traps, blue for water, and simulated trees and other hazards. Also, each page 18 except for that depicting the first hole will have a notch or cutout 28 in the upper right-hand corner thereof which cutouts in all the pages are of the same width but the cutouts in succeeding pages have a greater vertical height for a purpose described hereinafter with each cutout 28 being defined by a bottom edge 30 which extends to the outer edge of the page.

The inner surface of the back cover 14 or back page is provided with a score recording area generally designated by numeral 32 and includes a plurality of vertical columns 34 divided into segments by a plurality of spaced parallel horizontal lines 36. The first column is designated as the hole column and the vertically arranged segments thereof provide the hole numbers 1–18, the total and the net score at the bottom edge. Informational indicia is provided under the net score areas relating to course distances and par scores. The adjacent columns are provided with space at the upper end thereof for writing in the names of the players, either by name, or other designation.

The arrangement of the bottom edges 30 of the cutouts 28 is such that when the booklet is opened so that holes 1 and 2 are revealed, the cutout 28 in the right-hand page having hole 2 thereon will have its bottom edge 30 aligned with the second horizontal dividing line 36 thus indicating that the scores from holes 1 and 2 will be positioned above the bottom edge 30. As illustrated in FIG. 1, when the pages are open so that holes 5 and 6 are observable, the bottom edge 30 of the cutout 28 will coincide with the horizontal division line 36 immediately below hole 6, thus providing a guide for accurately positioning the score of the individual players for the holes depicted by the pages involved. As a further example, FIG. 2 illustrates holes 9 and 10 and the bottom edge 30 of the page having hole 10 thereon is positioned along the horizontal line 36 at the bottom edge of the hole 10 segment of the first column of the score recording area. This reduces the possibility of the scores for a particular hole being erroneously entered alongside of a different hole and this arrangement also provides a progressive actual score for each hole of the golf game as the game progresses. The rearmost page 18 may have the cutout 28 extending from top to bottom edge thereof and the surface facing the cover 14 may be provided with indicia 38 relating to the golf course and pictorial illustrations if desired. The inner inner surface of the rear cover 14 is also provided with an area 40 on which the score card may be dated and signed and also provided with pictorial illustrations if desired.

As indicated, various color arrangements can be employed on the pages of the booklet including handicaps and different par arrangements which may be illustrated by distinguishable colors and the hole depicted on the pages may include various reference lines connecting various portions of the hole or extending from various portions of the course to the green with numeral indicia indicating the distance factor associated with the particular reference line. Other indicia significant to playing a particular golf course may be provided as deemed necessary.

The enlarged size of each of the depicted holes is of considerable advantage to a golfer since it enables him to quickly and rapidly become familiar with each hole in an unfamiliar golf course. Also, the actual score recording space for each hole in the upper right-hand corner of the page on which the hole is depicted makes the score recording procedure less prone to accidentally entering the score for the wrong hole. Also, the pages may be provided with the par and other information on that portion of the page at the upper left corner. For example, when considering FIG. 1, information with respect to distances, pars and handicaps for hole 5 is designated at 42 and for hole 6 at 44. The page 18 having hole 1 depicted thereon includes the descriptive indicia 46 with which the numerical indicia for each hole is associated.

In addition, the cutouts 28 show the actual hole score descending as play progresses until the card is completed at the end of 18 holes. Various other information may be printed on the card such as the winner of major tournaments at the particular golf course, the designer, the professional or professionals and other relevant information thereby providing a significant souvenir item of the golf course.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A golf score card and hole information guide comprising a booklet consisting of front and rear cover pages and a plurality of intermediate pages foldable along a vertical centerline and bound together, each of the intermediate pages including an enlarged depiction of a hole of a golf course with the pages and holes being arranged in numeral succession, the interior surface of the rear cover including a score recording area thereon, and the intermediate pages including cutouts in the upper right-hand corner so that when the intermediate pages overlie the inner surface of the rear cover, the score recording area with be revealed to enable a score to be recorded thereon.

2. The structure as defined in claim 1 wherein the score recording area is divided into a plurality of vertical columns with each column including an area for placement of a player's name and each column being divided into a plurality of vertically oriented segments.

3. The structure as defined in claim 2 wherein each of the cutouts is provided with a bottom edge with the bottom edge of each cutout coinciding with the lower edge of the segments of the vertical columns associated with the holes depicted on the intermediate page associated with the score recording area whereby the score of each player may be recorded above the bottom edge of the cutout.

4. The structure as defined in claim 3 wherein the cutouts in successive pages are of greater vertical extent to provide progressive recording of scores as a game of golf progresses with the scores already recorded being oriented and observable in a descending relationship as the game progresses.

5. The structure as defined in claim 4 wherein each intermediate page includes indicia related to the hole depicted thereon.

6. The structure as defined in claim 5 wherein the cutouts when positioned to the left side of the booklet will reveal indicia relating to par and handicaps for the particular hole depicted on the page.

* * * * *